United States Patent [19]

Christensen

[11] Patent Number: 4,883,191

[45] Date of Patent: Nov. 28, 1989

[54] RELEASABLE CHAIN KEEPER

[76] Inventor: Kean Christensen, 807 Avenue "C", Billings, Mont. 59102

[21] Appl. No.: 255,661

[22] Filed: Oct. 11, 1988

[51] Int. Cl.[4] ..... A47F 5/08

[52] U.S. Cl. ..... 220/83; 254/382; 24/116 R

[58] Field of Search ..... 220/83; 254/382, 272; 24/116 R, 116 A; 59/87, 93

[56] References Cited

U.S. PATENT DOCUMENTS

| | | | |
|---|---|---|---|
| 1,450,176 | 4/1923 | Hopkins | 24/116 R |
| 2,184,814 | 12/1939 | Nagamatsu | 524/116 R |
| 2,859,937 | 11/1958 | Robins et al. | 254/167 |
| 3,793,904 | 2/1974 | Grable | 254/382 |
| 3,961,711 | 6/1976 | Perks | 211/117 |
| 4,043,538 | 8/1977 | Schreyer | 254/168 |

*Primary Examiner*—Stephen Marcus
*Assistant Examiner*—Gilbert W. Reece
*Attorney, Agent, or Firm*—Wells, St. John & Roberts

[57] ABSTRACT

A keeper is disclosed for releasable attachment to a chain in order to support a gathered length of the chain at a safe, yet accessible overhead location above the ground surface. The keeper includes a tubular body which can be used to accumulate a length of chain. A finger at an upward, open end of the body may be releasably hooked between openings of adjacent links of the chain in order to suspend the keeper and the accumulated chain length at the selected elevation. The finger is preferably resilient or, alternatively, pivotal to facilitate disengagement of the keeper from the chain by simply pulling downwardly on the keeper handle. The keeper may be completely removed from the chain by pulling forcibly downward on the keeper to disengage the finger from the chain and allow the keeper and chain to move downwardly to the point where the keeper becomes completely disengaged from the chain.

7 Claims, 3 Drawing Sheets

RELEASABLE CHAIN KEEPER

TECHNICAL FIELD

The present invention relates to retention of suspended chains within a releasable receiver.

BACKGROUND OF THE INVENTION

Suspended chains are found frequently about areas such as fuel refineries for the purpose of operating overhead valves. The chains typically hang in a loop with bottom ends situated typically in the vicinity of three or four feet above ground. These chains represent a potential hazard to workers in the area, especially those riding open vehicles such as bicycles. The hanging chains are especially hazardous at night or in inclement weather where they are not easily visible. It therefore becomes desirable to keep the chains at a safe but accessible elevation above the ground surface.

A partial solution to the problem has been utilized in the industry. The solution offered has been a form of fabric or other flexible closure by which the loop at the end of the chain is closed. While this may effectively prevent the chain from slipping around, say, the neck of the passing worker, it does not aid in maintaining the chain free from the pathway of the individual.

Chain keepers have been developed for receiving slack chain in relation to a chain hoist. U.S. Pat. Nos. 2,859,937 and 4,043,538 both disclose baskets for receiving slack chain. These baskets are attached securely to the chain hoist and are adjacent to the chain discharge from the hoist. They will therefore receive the chain and hold it at a selected elevation. However they are not removable to gain access to the chain, without requiring use of tools. Such apparatus would therefore not lend itself to use as a releasable chain receptacle since mounting and dismounting of the keeper would take an excessive amount of time. Furthermore mounting for the device, being along the framework of the associated chain hoist, would not easily lend itself to attachment to the chain. The keeper requires support apart from the chain in order to effectively receive the chain length. If attached to the chain, the keeper would simply move up and down along with the chain as it is taken up and paid out.

U.S. Pat. No. 3,961,711 to Perks discloses an overhead storage apparatus. This device is a telescoping arrangement including a rod that is attached to a ceiling and a tubular article carrying member which is slidably supported along the length of the rod. The rod includes a hooked lower end that can be selectively attached to the top or bottom end of the tube. The tube can be selectively moved down along the rod and hooked at its top end in a lower, access position or raised over the rod and hooked at the bottom end at an elevated storage position.

Perks requires use of a substantially rigid rod and a relatively permanent mounting arrangement between the rod and tubular member. Such an apparatus would not adequately function to receive a suspended chain for releasably storing the chain at a selected elevation above the ground surface.

The subject invention is intended to overcome these problems and provide a releasable device that is selectively operated from a ground or floor surface to receive and store a suspended length of chain in a safe, overhead location. The device is also provided to facilitate quick removal of the device to allow the chain to resume its original suspended position for access by a user. The device may be completely removed from the chain to facilitate access and normal operation of the chain by a user.

These and additional objects and advantages of the present invention will become evident upo reading the following detailed description.

BRIEF DESCRIPTION OF THE DRAWINGS

Preferred forms of the prevent invention are illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 9:
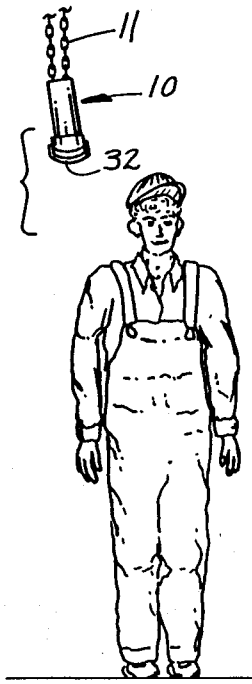
FIGS. 7–9 are operational schematics indicating installation and use of the present device.

The present keeper is generally identified in the drawings by the reference numeral 10. It is the purpose of the present keeper 10 to releasably receive and secure a suspended length of flexible filament such as a link chain 11. The chain 11 includes a number of interconnected chain links 12 defining spaces or openings 13 between connected links. The keeper is provided to receive and support a gathered length of the chain at a selected elevation by selective engagement with the chain through one of the openings or spaces 13 thereof. Use of the device is indicated by the succession of diagrams at FIGS. 7–9 where a chain 11 is shown in a normal, suspended orientation. The chain may depend from a support structure, such as a valve or other apparatus (not shown) that is actuated by pulling against one side of the chain loop. The present keeper is utilized as a safety device to gather and support the chain in an overhead orientation as shown in FIG. 9. The worker indicated in that FIG. is now able to move about the area previously occupied by the suspended chain without fear of running into or being caught by the chain.

The present keeper 10 preferably includes an elongated tubular body 18. The body 18 extends from an open top end 19 downwardly to a bottom end 20 that is at least partially closed. A handle 32 is advantageously provided adjacent the bottom end 20 to provide hand access for placing and removing the device with respect to a chain 11.

Figure 6:
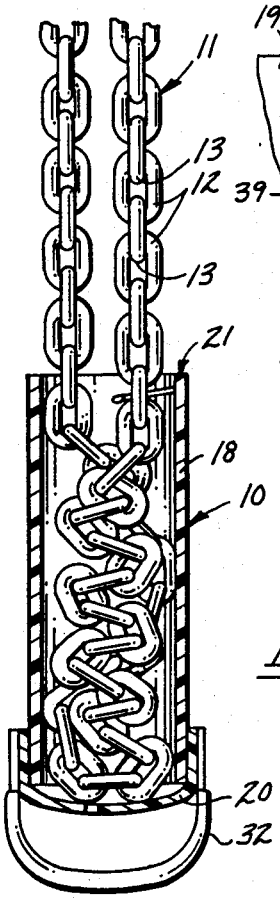
FIG. 6 is a sectional view similar to FIG. 4 only showing the keeper in operation holding a gathered length of chain.
Figure 7:
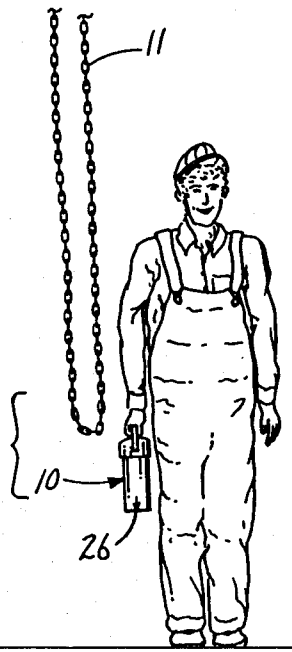

A hanger means 21 is provided adjacent the open top end 19. Hanger means 21 is selectively engageable with the chain 11 for supporting the tubular body 18 and a gathered length of the chain substantially as shown in FIGS. 6 and 9. The hanger means 21 is also functional for selectively releasing the chain to facilitate complete removal of the tubular body from the chain, thereby restoring it to the original accessible suspended position as shown in FIG. 7.

Referring in more detail to the tubular body 18, it will be seen that the body 18 is formed preferably from a lightweight, noncorrodible material such as a plastic or synthetic resin. While other materials may also be utilized, plastic is appropriate due to the relatively low cost of materials and to the fact that many forms of plastic materials are not adversely affected by temperature fluctuations, exposure to rain and snow, or exposure to various chemicals. Plastic can also be easily molded or shaped into a desired tubular configuration for the device. The handle 32 and bottom end 20 are also formed of similar noncorrosive materials. In fact, these elements may be integral with the body.

Figure 10:
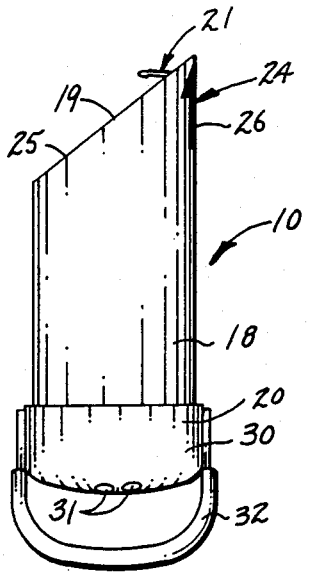
FIG. 10 is a front elevation view of the device utilizing an alternative indicator means for visibly identifying the position of a hanger means on the present device.

An indicator means 24 is situated adjacent a top edge 23 of the body 18. Indicator means 24 is preferably in the form of an arrow 26 on the body 18 to visibly indicate the position of the hanger means 21 to the user. Alternatively, the indicator means 24 may be substantially integral with the tubular body in the form of, for example, a bevel edge 25. The edge 25 as shown in FIG. 10 is angled away from the hanger means 21, thereby identifying the location of the hanger means. The bevel edge also exposes the hanger means 21 for visual identification to facilitate mounting of the device on a length of chain. The bevel edge 25 may be utilized with or without the arrow indicator 26 on the outer surface of the body which also provides visual indication of the location of the hanger means 21. Other appropriate indicator means may also be utilized without departing from the scope of this invention. The bottom end of the tubular body 18 includes a cap 30. The cap 30 is utilized to substantially close the bottom 20. It may be formed of a separately attached cover as indicated in the drawings, or it may be provided integrally with the tubular body 18. Preferably, the cap includes one or more holes 31 that facilitate draining of any fluids that might otherwise accumulate within the tubular body during use.

The handle 32 is attached to the cap 30 and may take the form shown in the drawings or may be provided in other forms that would facilitate an engagement for installing and removing the device from a suspended length of chain.

Figure 11:
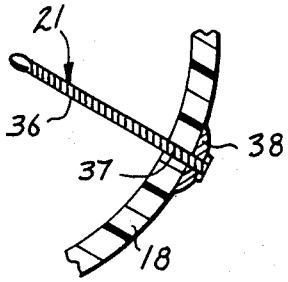
FIG. 11 is an enlarged sectional detail of a mount for a hanger device.

Two forms of the hanger means 21 are shown and described herein. A first preferred form includes a resilient finger 36. The finger 36 includes a base end 37 that is secured by appropriate fastening means such as adhesive to the tubular body 18. A reinforcing grommet 38 may also be used as illustrated in FIG. 11 to provide additional longitudinal stability to the resilient finger 36.

Figure 5:
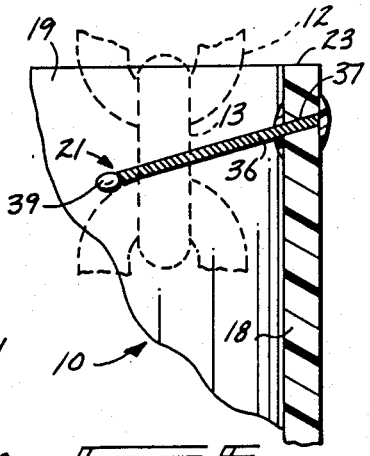
FIG. 5 is an enlarged sectional view taken substantially along the line 5—5 in FIG. 2.
Figure 3:
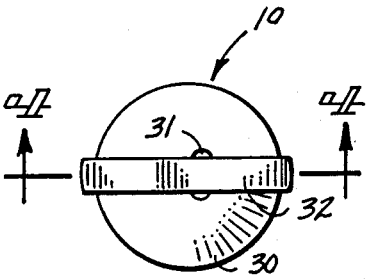
FIG. 3 is a bottom plan view as seen from below in FIG. 1.

It is preferred that the finger 36 be downwardly inclined as shown in FIG. 5 to facilitate "hooking" of the device onto a chain. The downwardly inclined finger also prevents unintentional disengagement of the device from the chain, since the weight from the device and accumulated chain will tend to pull downward, drawing the finger further through the engaged chain opening.

Figure 1:
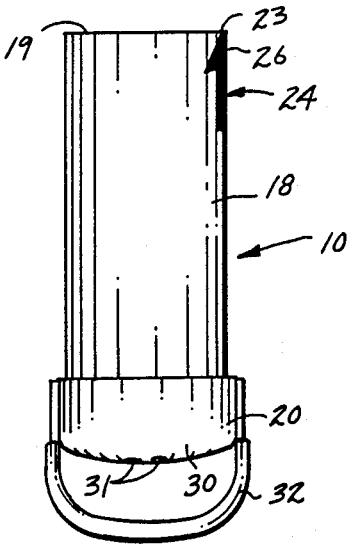
FIG. 1 is a front elevation view of a first form of the present invention.
Figure 4:
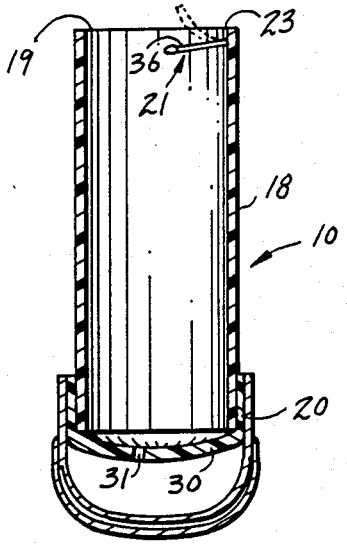
FIG. 4 is a cross-sectional view taken substantially along the line 4—4 in FIG. 3.
Figure 2:
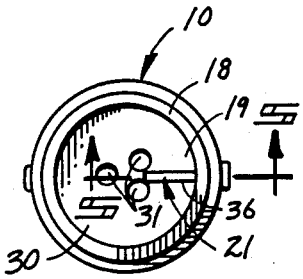
FIG. 2 is a top plan view as seen from above in FIG. 1.

The resilient finger 36 may be formed of a tightly wound metal wire that will facilitate resilient deflection along the length of the finger as indicated by the dashed line in FIG. 4. A product known as "packer pulling cable" is particularly suited to use for this purpose. Packer pulling cable is substantially similar to existing forms of vehicle speedometer cables in that it is relatively stiff along its length but will deflect resiliently under lateral forces. A resilient finger 36 formed of "packer pulling cable" having a length dimension of approximately 1.5 inches and an external diameter of approximately 0.125 inches has been found to operate effectively when secured to a chain to support the connected body 18 and an accumulated length of chain equaling approximately 10 pounds.

The flexible finger member 36 facilitates removal of the keeper 10 from the chain by a simple pull downwardly on the handle 32. The finger 36 will flex laterally responsive to the pulling force and flex upwardly to disconnect itself from the chain to facilitate removal of the body and to allow the chain to move back downwardly to its normal, suspended orientation.

Figure 12:
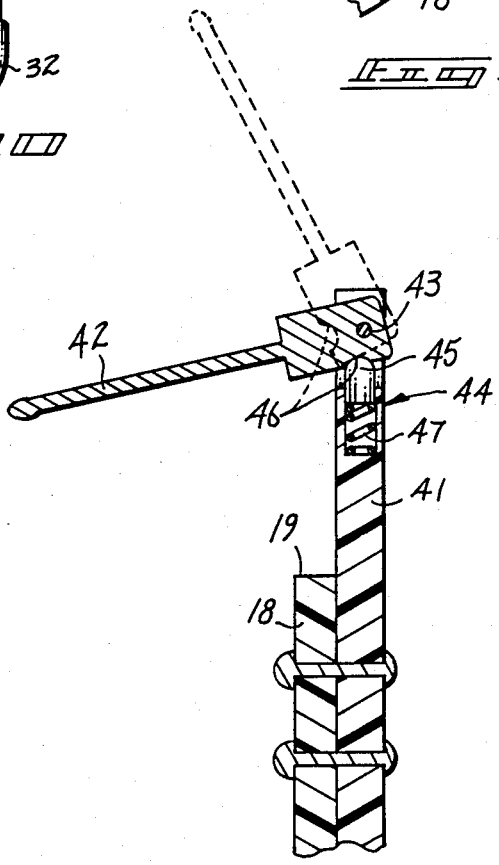
FIG. 12 is detailed sectional view of an alternative form of hanger mechanism.

An alternative preferred form of hanger means is illustrated in FIG. 12 in which a rigid finger 42 is utilized. The rigid finger 42 formed of a noncorrodible material is mounted at a pivot 43 on the tubular body or an upward extension thereof. The finger 42 may be mounted to an upwardly projecting bracket 41 provided as an attachment to or part of the body 18. The bracket may also serve as the indicator means, as it will visually indicate the position of the finger 42.

A detent means 44 is provided including a ball 45 releasably received within a notch 46 at the base end of the finger 42. The ball 45 is biased by a compression spring 47 into the notch 46. The ball 45 will be deflected by cam action of the rigid finger as upward forces are applied against the finger responsive to a downward pull on the keeper handle 32. The amount of downward pulling force required to release the detent may be selectively adjusted by the shape of the notch, the ball, or the compressive force of the spring. Thus, a pulling force applied against the finger 42 as when the handle 32 is grasped and pulled downwardly, will cause the finger to pivot upwardly and slide from engagement between successive links of the chain.

Figure 8:
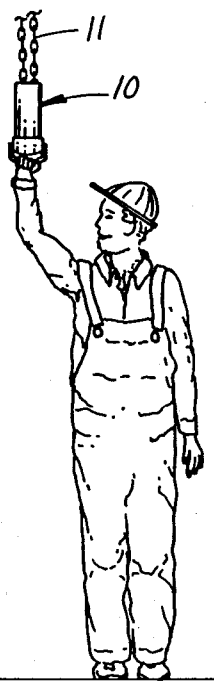

Installation and operation of the present invention is best understood with reference to FIGS. 7–9.

As shown in FIG. 7, the chain 11 will hang in its normal suspended orientation prior to installation of the present keeper 10. Here, the chain is accessible for use in actuating an associated mechanism (not shown). However, the chain extends downward and becomes a potential hazardous obstacle to any workers in the vicinity. A worker may gather an amount of the chain within the tubular body 18 to place the chain in an accessible yet safe overhead orientation. This is done simply by placing the bottom end of the chain within the tubular body and lifting the body upwardly. The chain will accumulate within the tubular body as the body is elevated to a position overhead as shown in FIG. 8.

The worker may now engage the hanger means 21 with the chain to secure the accumulated length of chain and the keeper 10 in place at the suspended, overhead elevation. This is done by simply inserting the resilient finger 36 or the rigid finger 42 of the alternative embodiment through an appropriate adjacent opening between links of the chain. This relationship is shown in FIGS. 5 and 6.

The finger extends through the opening of the chain to support the tubular body and the accumulated length of chain. Insertion of the finger is made simply by moving the upward end of the tubular body laterally with the indicator means 24 in alignment with the chain. The openings between successive links of the chain are common along the length of the chain so an opening will typically be easily accessed for insertion of the flexible or rigid finger. The inclined finger will slide laterally through the opening to attach the keeper to the chain. Once this is accomplished, the user can release the keeper as the resilient finger will now bear the weight of the keeper and the accumulated length of chain. The entire unit will remain in the position selected.

When it is desired to access the chain for use, a user may simply disengage the keeper from the chain simply by pulling the keeper downwardly. This is done by grasping the handle 32 and pulling in a downward direction substantially parallel to the length of the chain. Enough pulling force is exerted to cause the resilient finger 36 to flex and disengage from the chain. In the alternative embodiment, the rigid finger 42 will also deflect upon application of sufficient pulling force to overcome the detent mechanism. The tubular body can now be lowered and removed from the chain. The chain is now completely freed. The tubular body is completely disengaged from the chain. The chain is now free for use.

It is important to note that the present keeper 10 is completely removable from the chain to free the chain for use in the normal manner without obstruction by the keeper. Later, when the chain is no longer in use, the keeper 10 may be reapplied to lift a length of the chain upwardly to an accessible, yet safe, overhead elevation.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A releasable keeper for releasably storing a suspended length of open link chain, comprising:

an open tubular body having an open top end and an at least partially closed bottom end adapted to receive and contain a gathered length of the chain; and hanger means on the tubular body adjacent the open top end thereof including a movable finger selectively engageable with the chain for supporting the body and gathered length of the chain, and for selectively moving to release the chain responsive to a direct downward pull applied to the tubular body to facilitate complete removal of the tubular body from the chain.

2. The keeper of claim 1 further comprising a handle on the tubular body adjacent the bottom end thereof.

3. The keeper of claim 1 further comprising indicator means on the tubular body for visibly identifying the position of the hanger means.

4. The keeper of claim 1 wherein the indicator means is comprised of an edge surface along the open top end of the tubular body, angled toward the hanger means.

5. The keeper of claim 1 wherein the finger is resilient and is mounted to and extending into the tubular body adjacent the top end thereof for reception between selected open links of the chain and for releasably supporting the gathered chain and body by such engagement with the chain.

6. The keeper of claim 1 wherein the tubular body is elongated and wherein the hanger means is mounted to an outward end of a bracket on the body extending axially outward beyond the open body end.

7. The keeper of claim 1 wherein the movable finger is rigid and is adapted to be received between selected open links of the chain; and detent means for releasably holding the finger for pivotal movement between (a) an operative position projecting substantially inward in relation to the central axis for selective engagement between open links of the chain to suspend the body and a gathered length of the chain therein, and (b) an inoperative position for releasing the chain and enabling the tubular body to be removed from the chain.

* * * * *